United States Patent [19]

Rawlings et al.

[11] Patent Number: 4,663,780

[45] Date of Patent: May 12, 1987

[54] PAD FOR ABSORPTION OF BODY ODOR

[76] Inventors: Stephen A. Rawlings; Amanda J. Rawlings, both of 37 First Avenue, Amersham, Buckinghamshire, England

[21] Appl. No.: 790,821

[22] Filed: Oct. 24, 1985

[30] Foreign Application Priority Data

Oct. 24, 1984 [GB] United Kingdom ..... 8426934
Jul. 10, 1985 [GB] United Kingdom ..... 8517416

[51] Int. Cl.[4] ..... A41D 27/12
[52] U.S. Cl. ..... 2/53
[58] Field of Search ..... 36/43, 44; 2/53, 54, 2/56

[56] References Cited

U.S. PATENT DOCUMENTS 3,756,924 11/1964 Wonacoh ..... 2/53

*Primary Examiner*—Doris L. Troutman

*Attorney, Agent, or Firm*—Silverman, Cass, Singer and Winburn, Ltd.

[57] ABSTRACT

This invention relates to the absorbtion of body odor and is concerned with a provision of a pad which can be incorporated into a garment e.g. at the armhole scye, to absorb odor.

The pad comprises a layer of charcoal felt sandwiched between two layers of cotton gauze which are cut to shape and size so as to fit into the base of an armhole scye of a jacket, dress, blouse or other garment.

The pad consists of two layers 10 and 11 of cotton gauze between which is sandwiched a layer of charcoal felt. The charcoal felt may be made in accordance with the process claimed in UK Pat. No. 1 310 011, the fibrous carbon used for the carbon felt being derived for example from an organic polymer fibre such as a carbohydrate fibre.

13 Claims, 7 Drawing Figures

PAD FOR ABSORPTION OF BODY ODOR

This invention relates to a pad for absorbtion of body odour and to a garment incorporating such a pad.

Body odour is particularly offensive and is suppressed by deodorants and anti-perspirants. These methods can cause an irritation to certain groups of people and so there is a need for an alternative method of deodourising clothes and people.

An object of the invention is to provide a deodourising device and a garment incorporating such a device. The primary object here is to absorb the odour which occurs when people perspire rather than to absorb the perspiration itself.

In accordance with the present invention a body odour absorbtion pad comprises a layer of charcoal felt sandwiched between two layers of foraminous fabric material.

Preferably a charcoal felt comprises activated fibrous carbon and the fibrous carbon may derived from an organic polymer fibre containing at least carbon, hydrogen, and oxygen. The organic polymer fibre may for example be pre-oxidised polyacronitrile or polyvinyl alcohol fibre. The organic polymer fibre may for example be a carbohydrate fibre.

Preferred fibres are viscous rayon, cuprammonium rayon or cellulose ester rayon.

The activated fibrous carbon is preferably produced by the process claimed in UK Pat. No. 1 310 011. Alternatively the activated fibrous carbon may be produced by the process claimed in UK Pat. No. 1 301 101.

The charcoal felt, in one example, is produced from a viscous rayon precursor material which is non-woven and is needle punched into a backing scrim and then impregnated with a mixture of organic halides and carbonized in an atmosphere of carbon dioxide. The precursor material is preferably not more than 2 mm thick and weighs no more than 260 g/m$^2$ and the charcoal felt has a dry weight of not more than 144 g/m$^2$. The foraminous fabric material may be cotton gauze and the charcoal felt may be fused to the fabric material. A garment may have the pads incorporated in it by cutting the pads to a size and shape to fit in the base of armhole scyes of the garment. The garment may for example be a jacket, dress, blouse, shirt, coat or jumper or tracksuit or any other garment having armholes.

Figure 1:
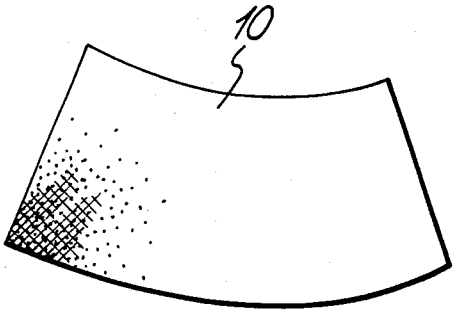
FIG. 1 is a plan view of a piece of cotton gauze forming the lower layer of the pad.
Figure 2:
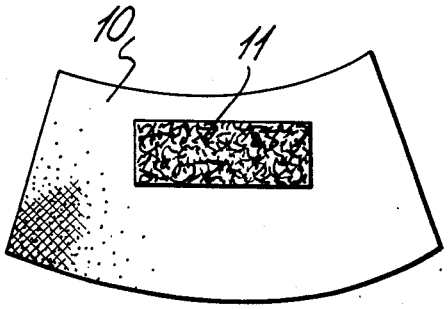
FIG. 2 shows a charcoal felt pad placed in position on the cotton gauze.
Figure 3:
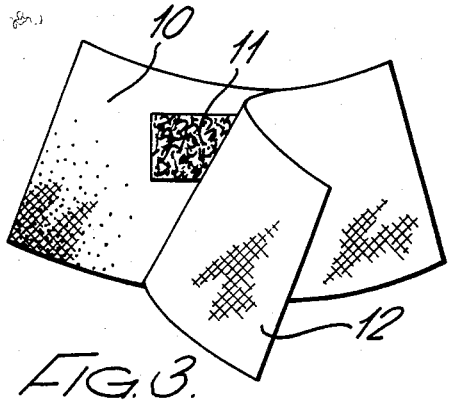
FIG. 3 shows the top cotton gauze positioned in place.

As shown in FIG. 1 a piece of cotton gauze 10 to which a fusible adhesive coating is applied, is cut to a predetermined pattern of an armhole scye and placed with the fusible coating uppermost. The charcoal felt 11 is placed in position on the layer of cotton gauze 10 as shown in FIG. 2, and then a second layer of cotton gauze 12 is placed over the first layer so as to sandwich the charcoal felt between the two layers of cotton gauze.

Figure 4:
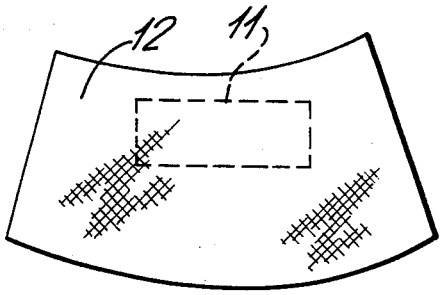
FIG. 4 shows the completed pad.
Figure 5:
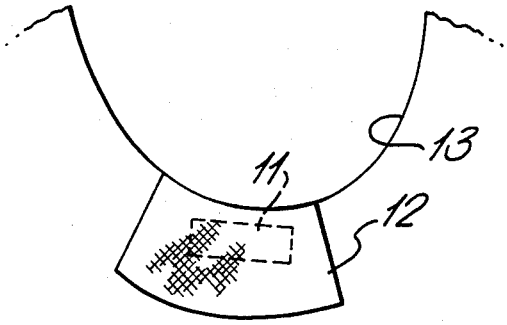
FIG. 5 shows the pad diagrammatically when in place in an armhole scye of a garment.

The three pieces of fabric are then placed together to allow the adhesive on the cotton gauze to melt fusing the three pieces of fabric together to form a pad as shown in FIG. 4. The pad can then be incorporated in the armhole scye 13 of a garment as shown in FIG. 5.

The pad can be positioned in the garment by various means such as:

stitching it into the armhole scye of the garment; or stitching onto the lining of the garment on the armhole scye area; or adhering it to the body of the garment in the area of the armhole scye; or adhering it to the lining of the garment in the area of the armhole scye.

Figure 6:
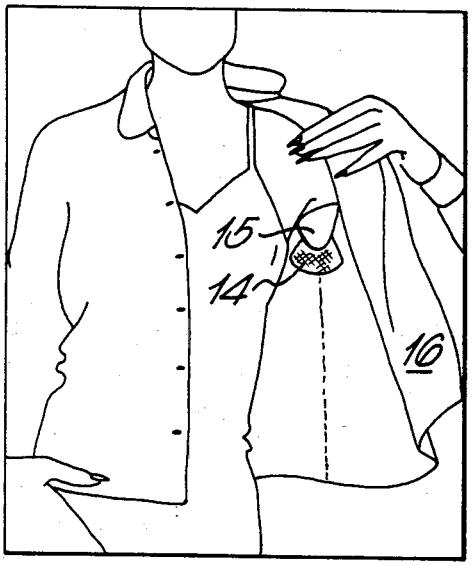
FIG. 6 shows in elevation a woman wearing a jacket incorporating pads embodying the invention.
Figure 7:
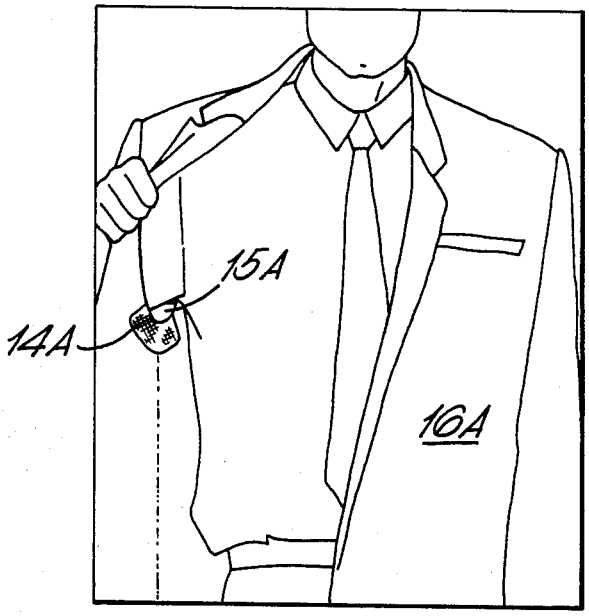
FIG. 7 shows in elevation a man wearing a jacket incorporating the invention.

In FIG. 6 an odour absorbing pad 14 embodying the invention is incorporated in the armhole scye 15 of a jacket 16 so that in use the pad lies just below the armpit and absorbs odour generated in this area. FIG. 6 illustrates the pad incorporated into a jacket worn by a female and FIG. 7 shows how the pad may be incorporated into the type of jacket worn by a male. In this case the ad 14A is incorporated into the armhole scye 15A of a jacket 16A.

The pads may be incorporated in a similar manner into other garments such as blouses, shirts, etc. as described above.

In use the charcoal felt absorbs odour and when the garment is washed the pad can be left in position since the charcoal felt and cotton gauze are washable and the odour absorbtion properties are not destroyed by normal washing. Instead of using cotton gauze as the fabric material rayon or other synthetic material may be used to form the gauze.

Although reference is made to preferred thicknesses and weights of the charcoal felt and the precursor material much greater thickness and weights e.g. as much as three times the preferred figures, may be employed.

The pads may be used with any type of garment with an armhole scye, with or without sleeves.

The term absorbtion is to be taken as embracing adsorption.

We claim:

1. A body odour absorbtion pad comprising a layer of charcoal felt and two layers of foraminous material, the charcoal felt being sandwiched between the two layers of foraminous fabric material.

2. A pad according to claim 1 in which the charcoal felt comprises activated fibrous carbon.

3. A pad according to claim 2 in which the fibrous carbon is derived from an organic polymer fibre containing at least carbon hydrogen and oxygen.

4. A pad according to claim 3 wherein said organic ploymer fibre is pre-oxidised polyacronitrile or polyvinyl alchohol fibre.

5. A pad according to claim 3 wherein said organic polymer fibre is a carbonhydrate fibre.

6. A pad according to claim 5 wherein said fibre is viscous rayon, cuprammonium rayon or cellulose ester rayon.

7. A pad according to claim 1 in which the charcoal felt is produced from a viscous rayon precursor material which is non-woven and is needle punched into a backing serim and then impregnated with mixture of organic halides and carbonised in an atmosphere of carbon dioxide.

8. A pad according to claim 9 and in which the precursor material is not more than 2 mm thick and weighs no more than 260 g/m$^2$ and the charcoal felt has a dry weight of not more than 144 g/m$^2$.

9. A pad according to claim 1 and in which the foraminous fabric material is cotton gauze.

10. A pad according to claim 1 and in which the charcoal felt is fused to the fabric material.

11. A garment having armhole scyes and having pads as claimed in claim 1 cut to size and shape to fit into the bases of armhole scyes of the garment.

12. A garment according to claim 11 in which the pad or pads are attached by one of the following methods:

(a) stitched into the armhole scye of the garment;

(b) stitched onto the lining of the garment on the armhole scye area;

(c) adhered to the body of the garment in the area of the armhole scye;

(d) adhered to the lining of the garment in the area of the armhole scye.

13. A method of manufacturing a pad according to claim 1 comprising the following steps:

(a) the cotton gauze with fusible coating on one side is cut to a pattern of an armhole scye and placed with the fusible uppermost;

(b) the charcoal felt is positioned on top of the cotton gauze;

(c) another layer of cotton gauze is placed, fusible face down on top of the charcoal felt and aligned with the first cotton gauze, both being the same shape in reverse; and (d) the three pieces of fabric are then pressed together to allow the adhesive on the cotton gauze to melt, fusing the three pieces of fabric together forming a pad.

* * * * *